US010294023B2

(12) United States Patent
Chang

(10) Patent No.: US 10,294,023 B2
(45) Date of Patent: May 21, 2019

(54) DEVICE FOR ROTATING COVER OF TRASH CAN

(71) Applicant: Janibell, Inc., Rancho Cucamonga, CA (US)

(72) Inventor: Kwang-Ok Chang, Seongnam-Si (KR)

(73) Assignee: Janibell, Inc., Rancho Cucamonga, CA (US)

( * ) Notice: Subject to any disclaimer, the term of this patent is extended or adjusted under 35 U.S.C. 154(b) by 114 days.

(21) Appl. No.: 15/585,763

(22) Filed: May 3, 2017

(65) Prior Publication Data

US 2018/0022545 A1 Jan. 25, 2018

(30) Foreign Application Priority Data

Jul. 25, 2016 (KR) ..... 10-2016-0094220

(51) Int. Cl.
*B65F 1/16* (2006.01)
*B65D 43/26* (2006.01)

(52) U.S. Cl.
CPC ..... *B65F 1/163* (2013.01); *B65D 43/262* (2013.01); *B65F 2001/1661* (2013.01)

(58) Field of Classification Search
CPC ..... B65F 1/163; B65F 1/1623; B65F 2001/1661; B65D 43/26; B65D 43/262; B65D 43/265; B65D 43/267
USPC ..... 220/262
See application file for complete search history.

(56) References Cited

U.S. PATENT DOCUMENTS 2,325,897 A * 8/1943 Waltman ..... A47J 36/12 220/264
2,456,840 A * 12/1948 Rogers ..... B65F 1/163 220/263
2002/0092853 A1* 7/2002 Wang ..... B65F 1/1623 220/263
2005/0017006 A1* 1/2005 Kuo ..... B65F 1/1607 220/263
2010/0084235 A1* 4/2010 Lu ..... B65F 1/163 188/280
2014/0246432 A1* 9/2014 Yang ..... B65D 43/262 220/262

* cited by examiner

*Primary Examiner* — Andrew D Perreault
(74) *Attorney, Agent, or Firm* — Larson & Larson, P.A.; Frank Liebenow; Justin P. Miller

(57) ABSTRACT

A device for rotating a cover of a trash can opens the cover so that a predetermined space is exposed, or closes the cover onto the frame so that the predetermined space is disconnected with the outside. The device includes an external force applying part rotated by first external force based on a fixed rotating shaft; and a mediating part which mediates the external force, interconnected to a rotation of the external force applying part by the external force to make the cover open. The cover closes by weight of the cover when the external force is released, in which when the standing of the cover is limited by second external force, the mediating part is transformed by the rotation of the external force applying part by the external force and prevents the external force from being transmitted to the cover.

6 Claims, 9 Drawing Sheets

(a)

(b)

(a)

(b)

DEVICE FOR ROTATING COVER OF TRASH CAN

CROSS-REFERENCE TO RELATED APPLICATION

This application claims priority from Korean application no. 10-2016-0094220 filed on Jul. 25, 2017, the disclosure of which is incorporated by reference.

FIELD

The present invention relates to a device for rotating a cover of a trash can, and more particularly, to a device for rotating a cover of a trash can, which prevents a cover from being damaged by external force applied by a user in a case where the standing of the cover of the trash, which is stood by the external force applied by the user, is limited by unexpected external force.

BACKGROUND

A trash can is divided into a trash can including a cover and a trash can including no cover, and the trash can including the cover is mainly used for a reason of a smell by trash or garbage or a fine appearance, but in order to block the smell by the trash or the garbage, a trash can, of which a cover is closed, is demanded.

In the related art, a trash can, in which a cover is rotated in a body and is automatically closed after trash is put into the trash can, is disclosed in Korean Patent Application Laid-Open No. 10-2008-0111435, but when an object is laid on the cover or the standing of the cover is limited by an application of unexpected external force, the cover or a member standing the cover is damaged by external force applied for standing the cover.

Further, when the cover is close, the cover is suddenly closed by weight of the cover, so that a part of the trash can, which is in contact with the cover, or the cover is damaged, and thus a solution therefor is urgently demanded.

What is needed is a device for rotating a cover of a trash can which prevents a cover from being damaged by external force applied by a user standing/sitting on the cover of the trash.

SUMMARY

The present invention has been made in an effort to provide a device for rotating a cover of a trash can, which prevents external force for opening a cover from being transmitted to the cover when the standing of the cover of the trash can is limited, thereby preventing the cover from being damaged, and simultaneously minimizing the damage of the trash can by decreasing a standing or lodging speed.

An exemplary embodiment of the present invention provides a device for rotating a cover of a trash can, which is mounted to a trash can formed with a predetermined space by a frame and a cover, and makes the cover be stood based on the frame so that the predetermined space is exposed to the outside, or makes the cover be lodged based on the frame so that the predetermined space is disconnected with the outside, the device including: an external force applying part rotated by first external force based on a first fixed rotating shaft fixed to the frame; and a mediating part, which mediates the external force applying part and the cover, and is interconnected to a rotation of the external force applying part by the first external force to make the cover be stood based on the frame, and makes the cover be lodged based on the frame by weight of the cover when the first external force is released, in which when the standing of the cover is limited by second external force, the mediating part is transformed by the rotation of the external force applying part by the first external force and prevents the first external force from being transmitted to the cover.

The mediating part may include a first connection part connected with the external force applying part, a transformation part connected with the first connection part and transformed by the rotation of the external force applying part by the first external force when the standing of the cover is limited by the second external force, and a second connection part connecting the transformation part and the cover, and when the second external force is not present, the transformation part may be interconnected by the first external force applied to the external force applying part and position-move the connected second connection part to make the cover be rotated based on the second fixing rotating shaft, and when the standing of the cover is limited by the second external force, the transformation part may be transformed by the rotation of the external force applying part by the first external force to prevent the second connection part from being position-moved.

When the second external force is not present, the transformation part may be transformed to have a second length from a first length by the first external force applied to the external force applying part, and when the standing of the cover is limited by the second external force, the transformation part may be transformed to have a third length from the first length by the first external force applied to the external force applying part, and the second length may be smaller than the third length.

The device may further include a movement speed decreasing part, which is mounted between the frame and the mediating part, is elastically transformed according to a position movement of the mediating part, and decreases a speed of the position movement of the mediating part.

The second connection part may include a transformation part connection part connected with the transformation part, and a cover connection part connected with the cover, and the movement speed decreasing part may include a lodging speed decreasing part, which is connected with the cover connection part while being fixed to the frame, is elastically transformed by the cover connection part interconnected with the cover when the cover is lodged, and decreases a lodging speed of the cover by restoration force by the elastic transformation, and a standing speed decreasing part, which is connected with the transformation part connection part while being fixed to the frame, is elastically transformed by the transformation part connection part interconnected with the cover when the cover is stood, and decreases a speed of the standing of the cover by restoration force by the elastic transformation.

The transformation part connection part may include a rotating connection part rotatably connected to a third fixed rotating shaft fixed to the frame, a first rotating part rotated based on the cover connection part while being connected to the cover connection part, a second rotating part rotated based on the transformation part while being connected with the transformation part, and a contact part which is in contact with the standing speed decreasing part.

When the first external force is applied to the external force applying part, the first rotating part may be rotated in a first direction based on the rotating connection part, and when the first external force applied to the external force applying part is released, the first rotating part may be rotated in a second direction based on the rotating connection part, and when the first rotating part is rotated in the second direction, the lodging speed decreasing part may be elastically transformed and provide restoration force.

When the first external force is applied to the external force applying part, the second rotating part may be rotated in a first direction based on the rotating connection part, and when the first external force applied to the external force applying part is released, the second rotating part may be rotated in a second direction based on the rotating connection part, and when the second rotating part is rotated in the first direction, the standing speed decreasing part may be elastically transformed by a contact with a contact part and provide restoration force.

The lodging speed decreasing part may include a position moving part connected with the transformation part connection part, a body part, which slides while accommodating the position moving part, and a spring part elastically transformed by the position moving part while being accommodated in the body part, and the body part may include a through-hole, through which air stored in a storing space is discharged to the outside, or external air flows into the storing space according to a change in a size of the storing space by the position movement of the position moving part, and a speed of the position movement of the position moving part may be determined according to the quantity of air flowing in or discharged through the through-hole.

A speed of the position movement of the position moving part may be decreased by air flowing in or discharged through the through-hole.

According to the present invention, when the standing of the cover of the trash can is limited, external force applied for opening the cover is prevented from being transmitted to the cover, thereby preventing the cover from being damaged.

Further, by decreasing a standing or lodging speed of the cover, it is possible to prevent the trash can from being damaged due to the sudden standing or lodging of the cover, thereby increasing life of the trash can, and it is possible to decrease noise by the sudden standing or lodging of the cover, thereby providing the comfortable trash can to a user.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
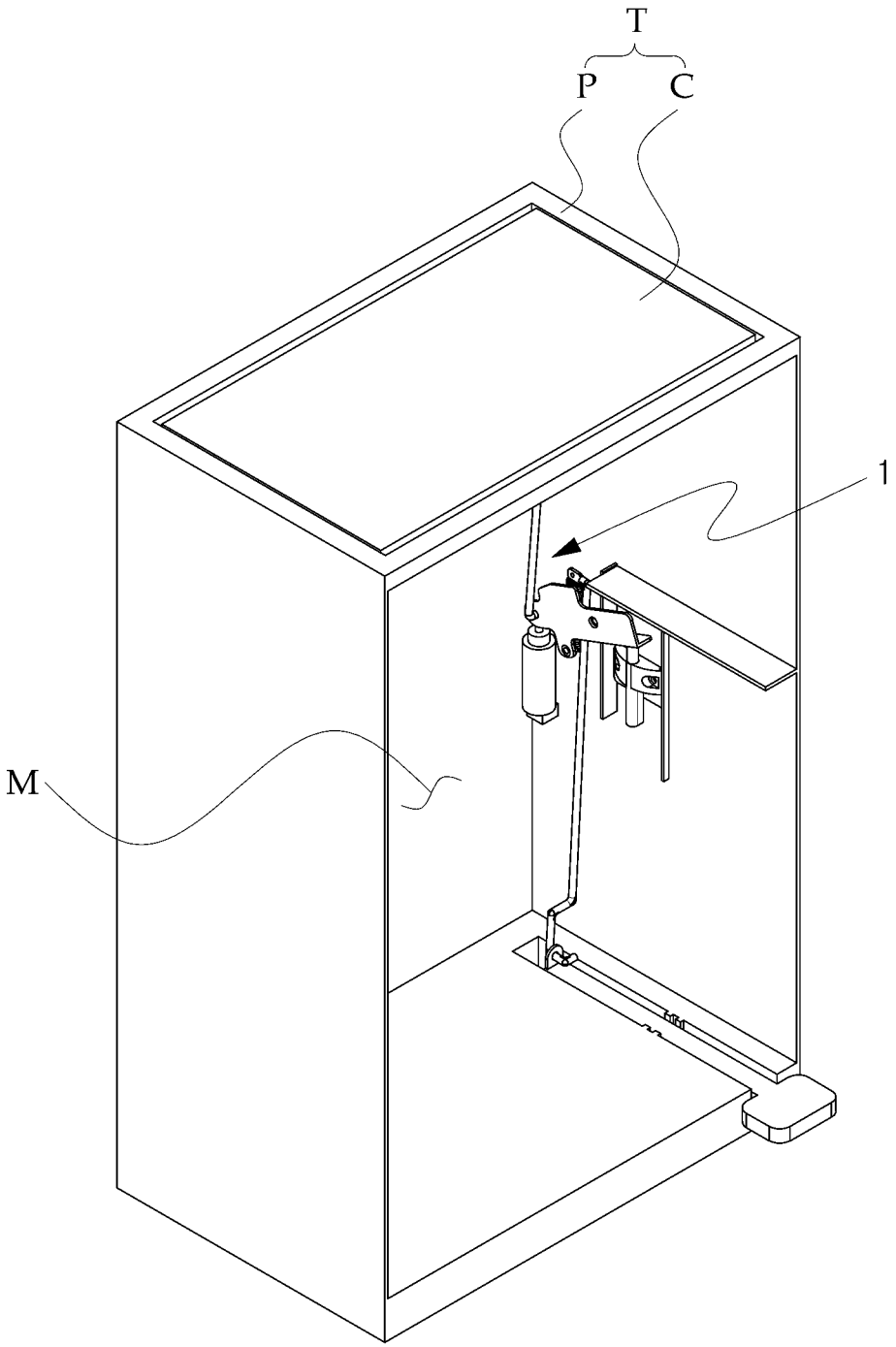
FIG. 1 is a schematic perspective view illustrating a trash can, on which a device for rotating a cover of a trash can according to an exemplary embodiment of the present invention is mounted.

Reference will now be made in detail to the presently preferred embodiments of the invention, examples of which are illustrated in the accompanying drawings. Throughout the following detailed description, the same reference numerals refer to the same elements in all figures.

Figure 2:
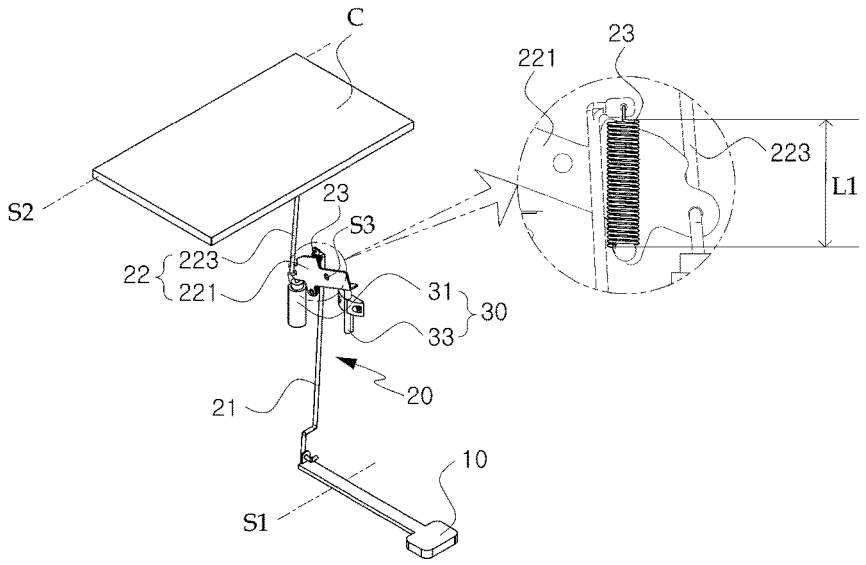
FIGS. 2 and 3 are schematic diagrams for describing an operation of the device for rotating the cover of the trash can according to the exemplary embodiment of the present invention.
Figure 2:
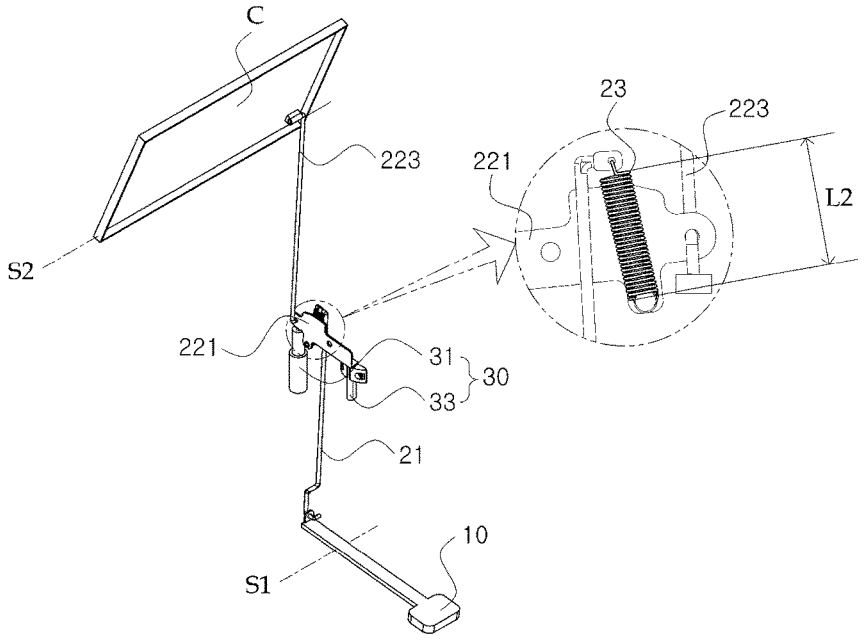
Figure 3:
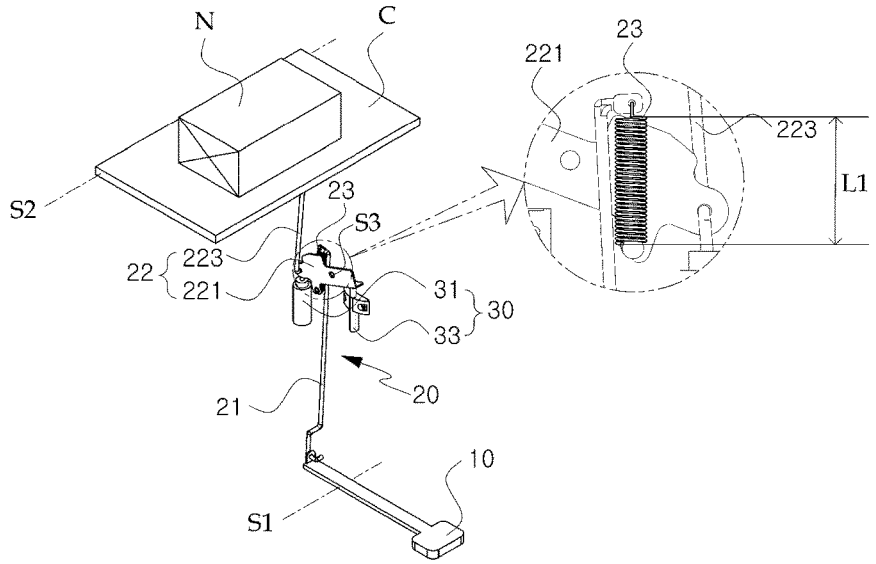
Figure 3:
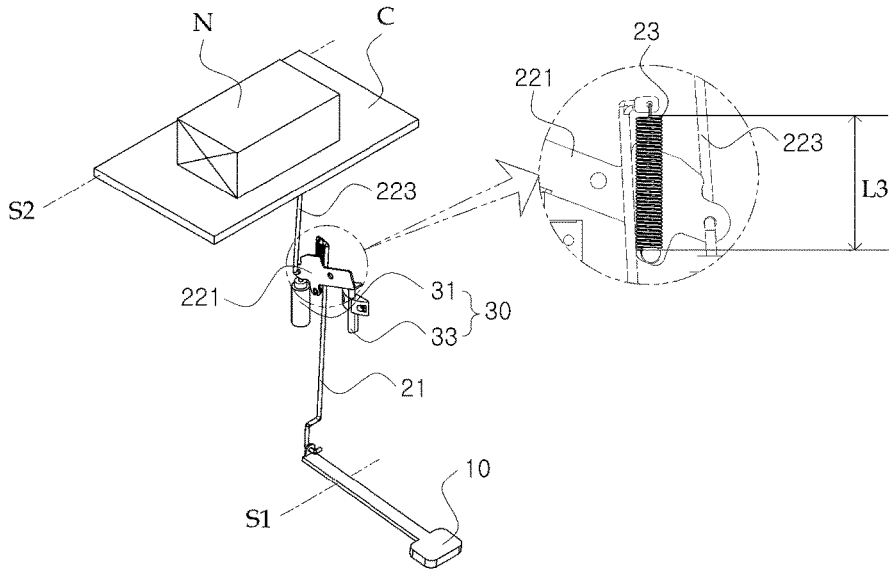

FIG. 1 is a schematic perspective view illustrating a trash can, on which a device for rotating a cover of a trash can according to an exemplary embodiment of the present invention is mounted, and FIGS. 2 and 3 are schematic diagrams for describing an operation of the device for rotating the cover of the trash can according to the exemplary embodiment of the present invention.

Referring to FIGS. 1 to 3, a device (hereinafter, referring to as "the rotating device 1) for rotating a cover C of a trash can T according to an exemplary embodiment of the present invention may be a device, which is mounted on the trash can T formed with a predetermined space by a frame P and the cover C and opens and closes the cover C so that the predetermined space is not exposed to the outside or the predetermined space is disconnected to the outside.

Here, the rotating device 1 may be a device, which is used in a storage box storing a product or a household item, of which the cover C needs to be opened and closed, and rotates the cover C.

The trash can T mounted with the rotating device 1 according to the exemplary embodiment includes a flame P, and the cover C, which is connected with a second fixing rotating shaft S2 fixed to the frame P and is rotated based on the second fixing rotating shaft S2.

When the cover C stands based on the second fixing rotating shaft S2, the cover C allows the predetermined space of the trash can T to be exposed, and when the cover C is lodged based on the second fixing rotating shaft S2, the cover C allows the predetermined space to be disconnected from the outside.

That is, a user makes the cover C be stood in order to put or take trash into or out of the predetermined space of the trash can T, and when the user does not use the trash can T, the user makes the cover C be lodged to prevent the trash stored in the predetermined space from being exposed.

The rotating device 1 according to the exemplary embodiment includes an external force applying part 10 rotated by first external force based on the first fixing rotating shaft S1 fixed to the frame P, and a mediating part, which mediates the external force applying part 10 and the cover C and is interconnected according to the rotation of the external force applying part 10 by the first external force to enable the cover to be stood based on the frame P, or makes the cover C be lodged based on the frame P by weight of the cover C when the first external force is released.

The first external force is force applied to the rotating device 1 so as to make the cover C of the trash can T be stood.

The mediating part 20 is transformed by the rotation of the external force applying part 10 by the first external force and prevents the first external force from being transmitted to the cover C when the standing of the cover C is limited by second external force.

That is, when the second external force is not applied, the mediating part 20 transmits the first external force applied to the external force applying part 10 to the cover C and allows the cover C to be stood, and when the second external force is applied, the mediating part 20 prevents the first external force applied to the external force applying part 10 from being transmitted to the cover C to prevent a direct collision between the first external force and the second external force, thereby preventing the rotating device 1 or the cover C from being damaged by the conflictive first external force and second external force.

The second external force may be force applied in a direction from an upper surface to a lower surface of the cover C which is lodged based on the frame C, that is, the second external force may be a case where an object N and the like hindering the standing of the cover C is laid.

Hereinafter, the rotating device 1 will be described in detail with reference to FIGS. 4 to 9.

Figure 4:
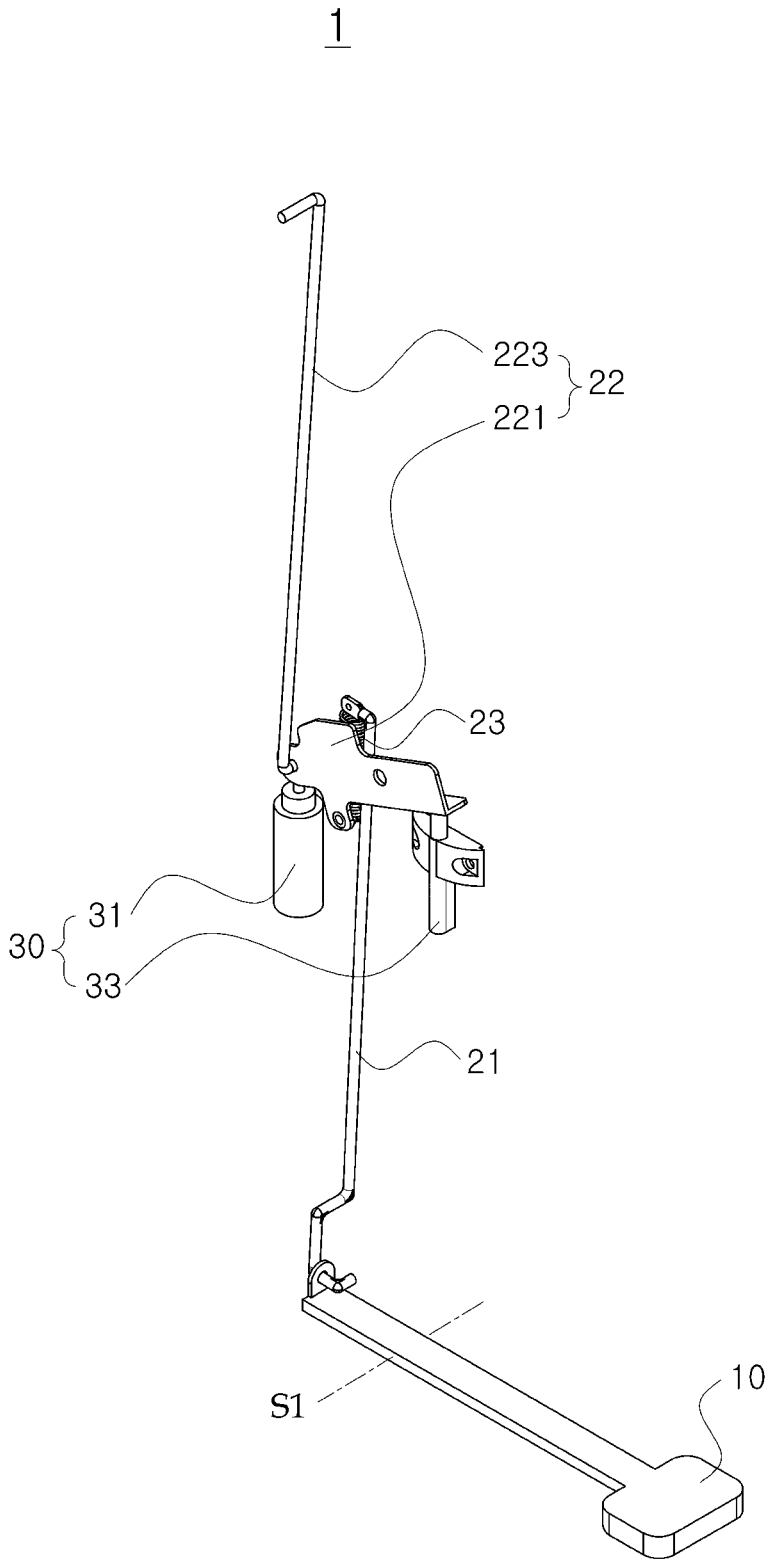
FIG. 4 is a schematic perspective view illustrating a trash can, on which a device for rotating a cover of a trash can according to an exemplary embodiment of the present invention.
Figure 5:
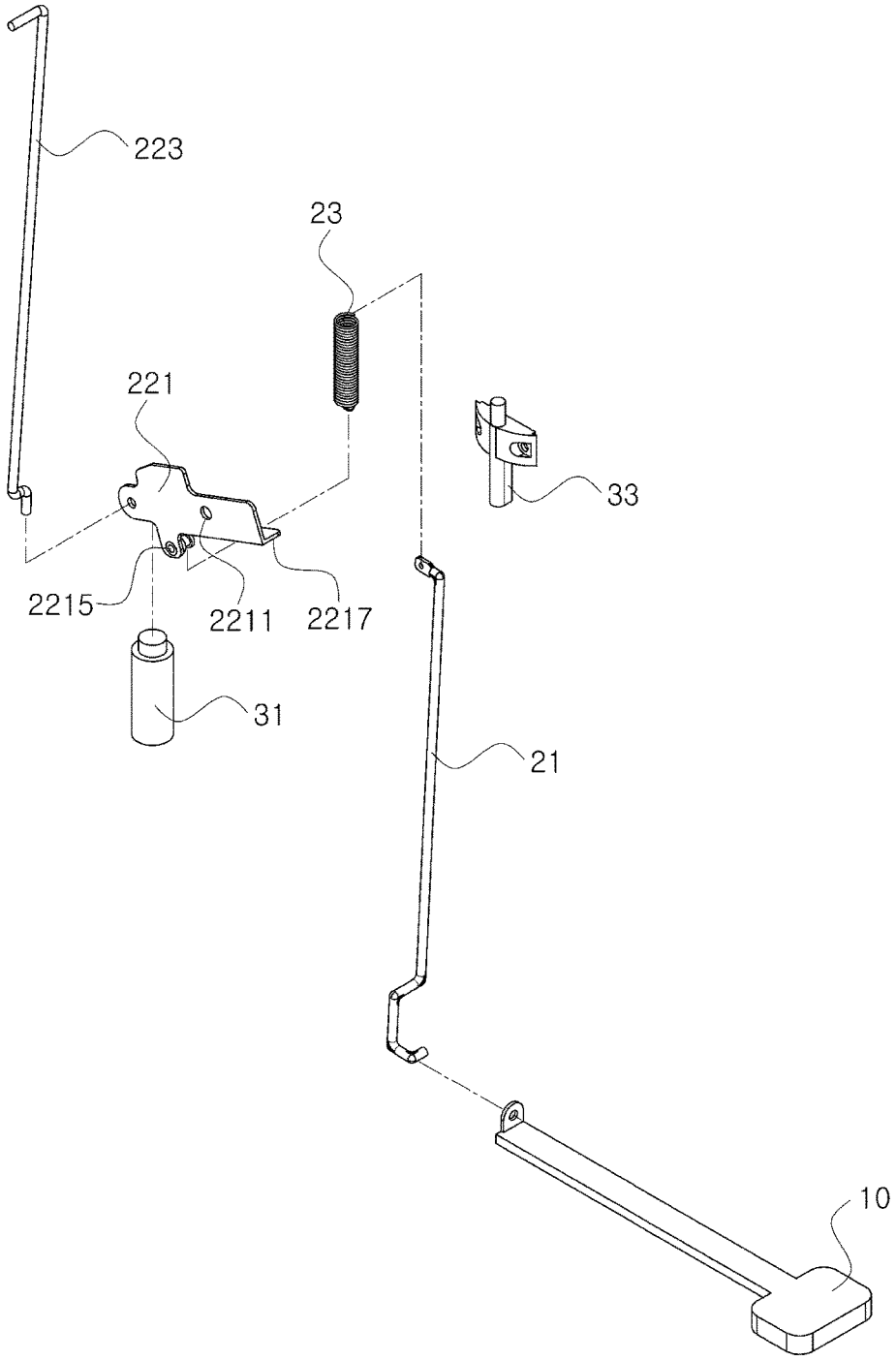
FIG. 5 is an exploded perspective view of the device for rotating the cover of the trash can according to the exemplary embodiment of the present invention.
Figure 6:
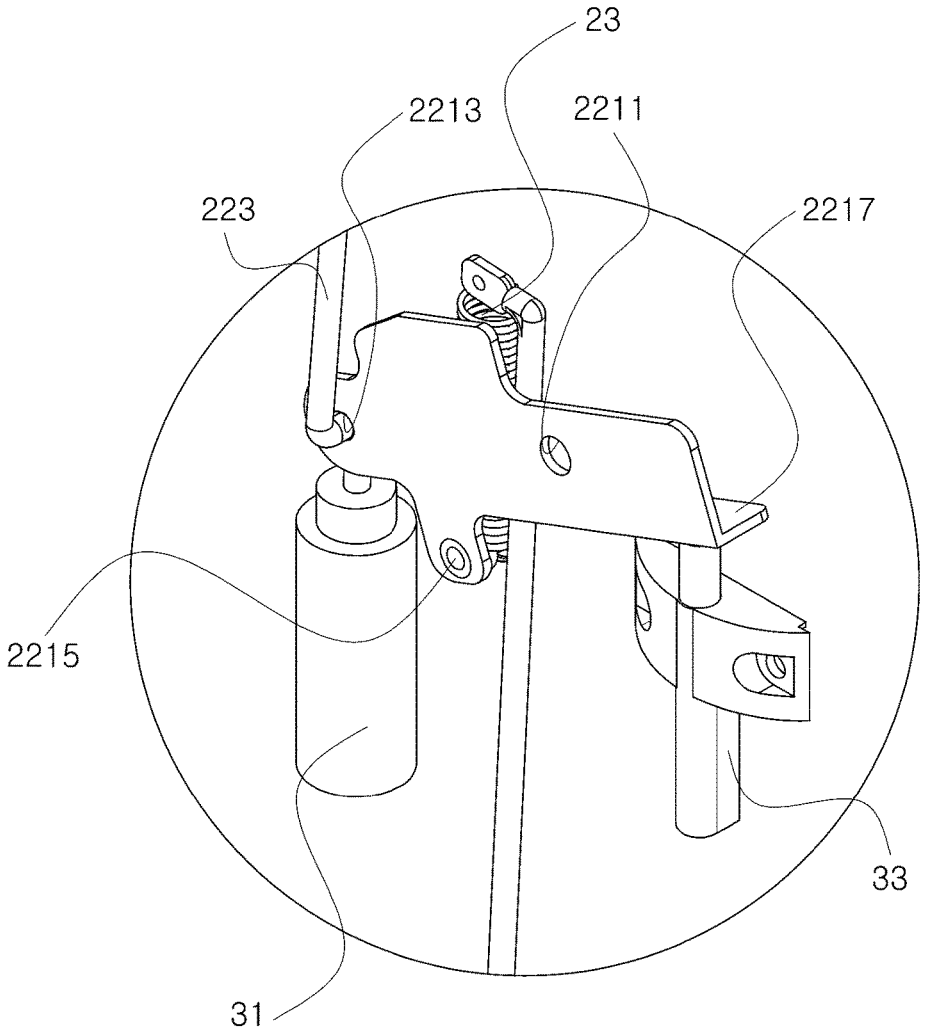
FIG. 6 is a schematic perspective view illustrating a part of the device for rotating the cover of the trash can according to the exemplary embodiment of the present invention.

FIG. 4 is a schematic perspective view illustrating a trash can, on which a device for rotating a cover of a trash can according to an exemplary embodiment of the present invention, FIG. 5 is an exploded perspective view of the device for rotating the cover of the trash can according to the exemplary embodiment of the present invention, and FIG. 6 is a schematic perspective view illustrating a part of the device for rotating the cover of the trash can according to the exemplary embodiment of the present invention.

Referring to FIGS. 4 to 6, the mediating part 20 of the rotating device 1 according to the exemplary embodiment includes a first connection part 21 connected with the external force applying part 10, a transformation part 23 connected with the first connection part 21 and transformed by the rotation of the external force applying part 10 by the first external force when the standing of the cover C is limited by the second external force, and a second connection part 22 connecting the transformation part 23 and the cover C.

The external force applying part 10 is positioned at a lower side of the trash can T to enable a user to easily apply the first external force by using a part (foot) of the body of the user.

The mediating part 20 mediates the external force applying part 10 and the cover C and is disposed in a height direction of the trash can T toward the cover C from the external force applying part 10.

The first connection part 21 is interconnected with a position movement of the external force applying part 10 and is position-moved while being in contact with the external force applying part 10, and the transformation part 23 is in contact with the first connection part 21 and is interconnected with the position movement of the first connection part 21.

When the second external force is not present, the transformation part 23 is interconnected by the first external force applied to the external force applying part 10 and position-moves the connected second connection part 22 to make the cover C be rotated based on the second fixing rotating shaft S2. Further, when the standing of the cover C is limited by the second external force, the transformation part 23 is transformed by the rotation of the external force applying part 10 by the first external force to prevent the second connection part 22 from being position-moved.

Particularly, when the second external force is not present, the transformation part 23 is transformed to have a second length L2 from a first length L1 by the first external force applied to the external force applying part 10, and when the standing of the cover C is limited by the second external force, the transformation part 23 is transformed to have a third length L3 from the first length L1 by the first external force applied to the external force applying part 10.

Here, the first length L1 means a length of the transformation part 23 in the state where there is no external force applied to the rotating device 1, and the second length L2 means a length of the transformation part 23 transformed by the first external force applied to the external force applying part 10. The second length L2 is equal to or larger than the first length L1, and the transformation part 23 in the state of the second length L2 enables the second connection part 22, which is position-moved and connected, to be position-moved while maintaining the second length L2.

The transformation part 23 may be an elastic body having elasticity, and may have restoration force, by which the transformation part 23 is elongated or contracted by the applied external force and is desired to be restored in a normal state.

The transformation part 23 is transformed to have the second length L2 by the position movement by the first external force, but when a size of restoration force by the transformation is equal to weight of the second connection part 22 and the cover C (in the state of the second length L2), the transformation part 23 is not transformed and position-moved to interconnect with the second connection part 22. Here, when elastic force causing the transformation of the transformation part 23 is equal to or larger than the weight of the second connection part 22 and the cover C, the second length L2 of the transformation part 23 may be the same as the first length L1.

In the meantime, when the standing of the cover C is limited by the second external force, the transformation part 23 is transformed to have the third length L3 by the first external force, and the third length L3 is larger than the second length L2. Particularly, the position movement of the transformation part 23 is limited by the second connection part 22 fixed by the second external force during a process of the position movement by the first external force, and from this time, the transformation part 23 is not position-moved and is elongated to be transformed to have the third length L3.

In this case, the restoration force of the transformation part 23 transformed to have the third length L3 may be approximately the same as the first external force. That is, the transformation part 23 may switch the first external force to elastic force and prevent the second connection part 22 from being position-moved, and thus, the cover C is prevented from being stood, and the standing power of the cover C collides with the second external force, thereby preventing the cover C or the rotating device 1 from being damaged.

The rotating device 1 according to the exemplary embodiment further includes a movement speed decreasing part 30, which is mounted between the frame P and the mediating part 20, is elastically transformed according to the position movement of the mediating part 20, and decreases a speed of the position movement of the mediating part 20.

The second connection part 22 includes a transformation part connection part 221 connected with the transformation part 23, and a cover connection part 223 connected with the cover C.

The movement speed decreasing part 30 includes a lodging speed decreasing part 31, which is connected with the cover connection part 223 while being fixed to the frame P, is elastically transformed by the cover connection part 223 interconnected with the cover C when the cover C is lodged, and decreases a lodging speed of the cover C by restoration force by the elastic transformation, and a standing speed decreasing part 33, which is connected with the transformation part connection part 221 while being fixed to the frame P, is elastically transformed by the transformation part connection part 221 interconnected with the cover C when the cover C is stood, and decreases a speed of the standing of the cover C by restoration force by the elastic transformation.

The transformation part connection part 221 includes a rotating connection part 2211 rotatably connected to the third fixed rotating shaft S3 fixed to the frame P, a first rotating part 2213 rotated based on the cover connection part 223 while being connected to the cover connection part 223, A second rotating part 2215 rotated based on the transformation part 23 while being connected to the transformation part 23, and a contact part 2217 which is in contact with the standing speed decreasing part 33.

Hereinafter, the transformation part connection part 221 position-moved by the first external force applied to the external force applying part 10 and the movement speed decreasing part 30 will be described with reference to FIGS. 7 and 8.

Figure 7:
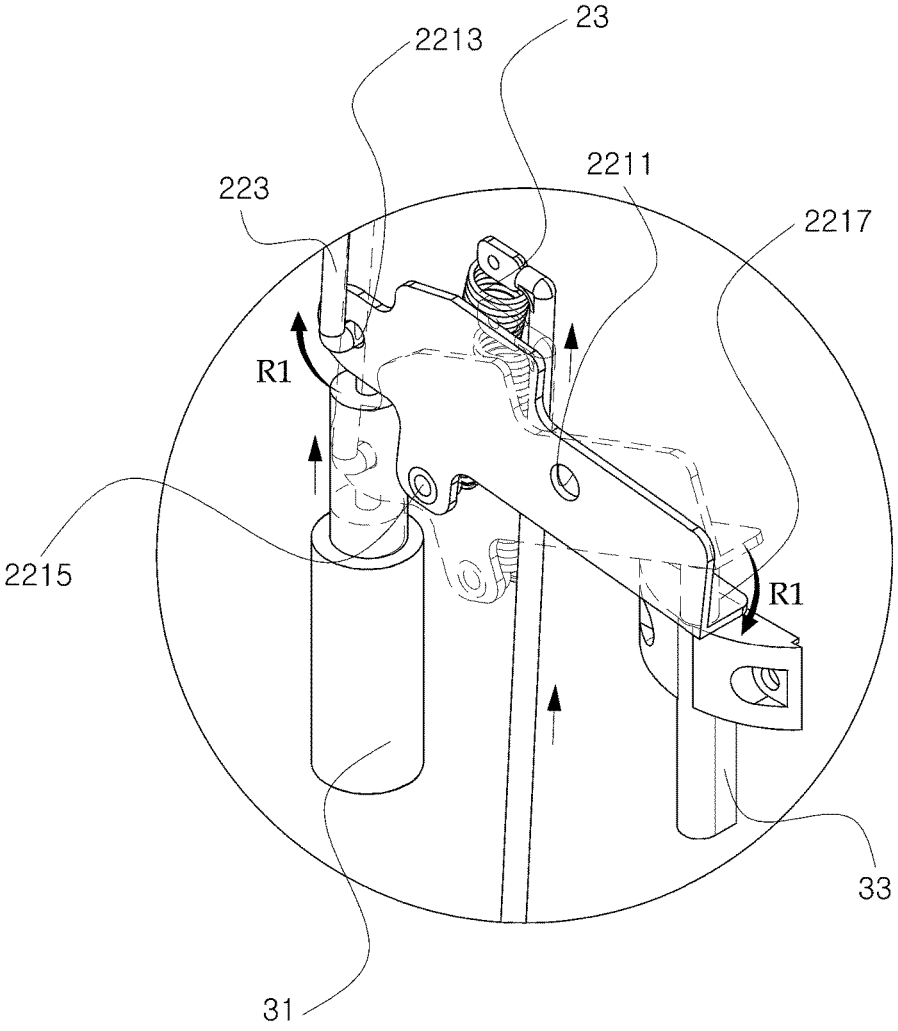
FIG. 7 is a schematic diagram for describing the standing of the cover by the device for rotating the cover of the trash can according to the exemplary embodiment of the present invention.

FIG. 7 is a schematic diagram for describing the standing of the cover by the device for rotating the cover of the trash can according to the exemplary embodiment of the present invention.

A process of an operation of the rotating device 1 by the first external force applied to the external force applying part 10 will be described with reference to FIG. 7.

In a state where the second external force is not applied, the external force applying part 10 is rotated based on the first fixing rotating shaft S1 by the external force applied to the external force applying part 10, so that the connected first connection part 21 is position-moved in an up direction, and the transformation part 23 connected to the position movement of the first connection part 21 is position-moved in the up direction.

The transformation part 23 is transformed to have the second length L2 by the position movement by the first external force, but when a size of restoration force by the transformation is equal to weight of the second connection part 22 and the cover C (in the state of the second length L2), the transformation part 23 is not transformed and position-moved to interconnect with the second connection part 22. Here, when elastic force causing the transformation of the transformation part 23 is equal to or larger than the weight of the second connection part 22 and the cover C, the second length L2 of the transformation part 23 may be the same as the first length L1.

The transformation part 23 is position-moved in the state of maintaining the second length L2, so that the rotation connection part 2211 is rotated based on a third fixing rotating shaft S3.

According to the rotation of the rotation connection part 2211, the first rotation part 2213 is rotated based on the rotation connection part 2211 in the first direction R1. Here, the first direction R1 may be a clockwise direction. When the first rotating part 2213 is rotated in the first direction R1, the connected cover connection part 223 is position-moved in the upper side, and the cover C connected with the cover connection part 223 is pushed to the upper side, so that the cover C is rotated based on the second fixing rotating shaft S2. That is, the cover C is stood based on the frame P.

In this case, the second rotating part 2215 is rotated based on the rotating connection part 2211 in the first direction R1. When the second rotating part 2215 is rotated in the first direction R1, the standing speed decreasing part 33 is elastically transformed by the contact with the contact part 2217 to provide restoration force.

That is, the contact part 2217 is in contact with the standing speed decreasing part 33 by the rotation of the second rotating part 2215 in the first direction R1 to cause an elastic transformation of the standing speed decreasing part 33, and thus, the rotation of the second rotating part 2215 in the first direction R1 is interfered by the standing speed decreasing part 33, so that a rotation speed of the second rotating part 2215 is decreased. The rotation speed of the second rotating part 2215 is decreased, so that a rotation speed of the first rotating part 2213 in the first direction R1 is decreased, and as a result, a speed of the position movement of the cover connection part 223 connected with the first rotating part 2213 is decreased, thereby decreasing a speed of the standing of the cover C.

In the meantime, when the standing of the cover C is limited by the second external force, the transformation part 23 is transformed to have the third length L3 by the first external force, and the third length L3 is larger than the second length L2. Particularly, the position movement of the transformation part 23 is limited by the second connection part 22 fixed by the second external force during a process of the position movement by the first external force, and from this time, the transformation part 23 is not position-moved and is elongated to be transformed to have the third length L3.

In this case, the cover connection part 223 connected with the first rotating part 2213 is not position-moved by the second external force, so that the first rotating part 2213 does not rotated in the first direction R1, so that only the transformation part 23 may be transformed. The restoration force of the transformation part 23 transformed to have the third length L3 from the first length L3 may be approximately the same as the first external force. That is, the transformation part 23 may switch the first external force to elastic force and prevent the second connection part 22 from being position-moved, and thus, the cover C is prevented from being stood, and the standing power of the cover C collides with the second external force, thereby preventing the cover C or the rotating device 1 from being damaged.

Figure 8:
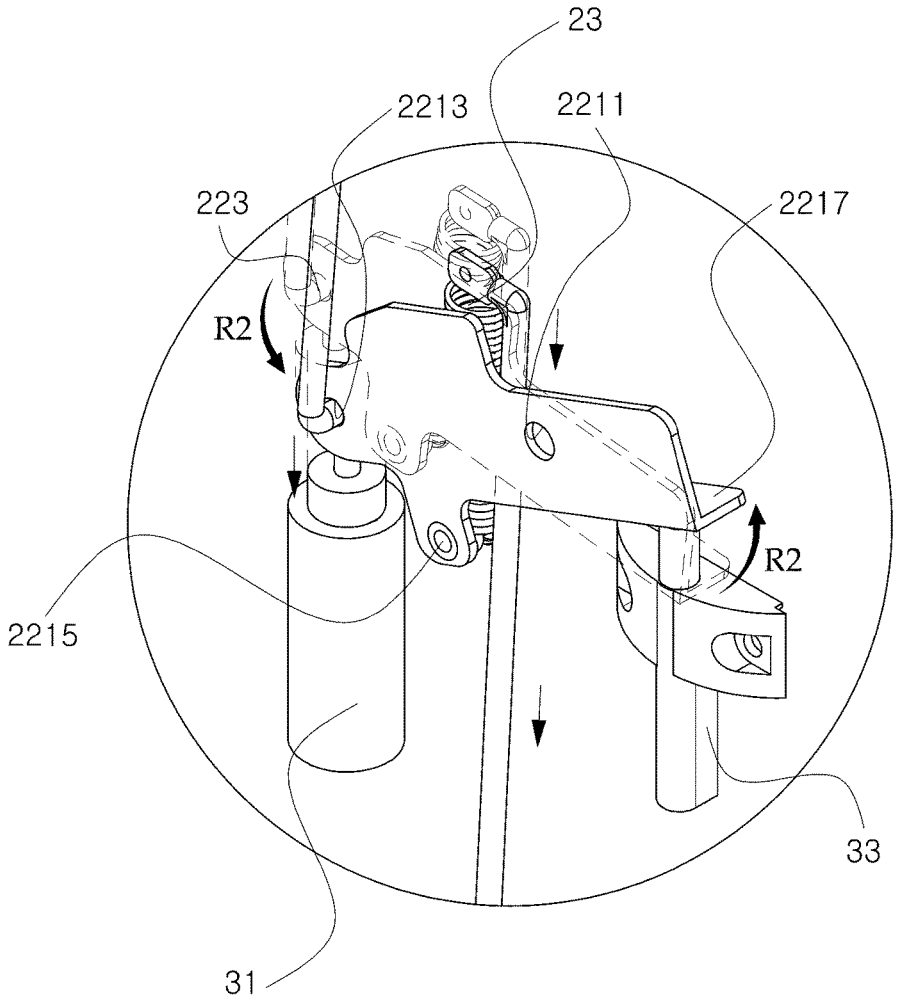
FIG. 8 is a schematic diagram for describing the lodging of the cover by the device for rotating the cover of the trash can according to the exemplary embodiment of the present invention.
Figure 9:
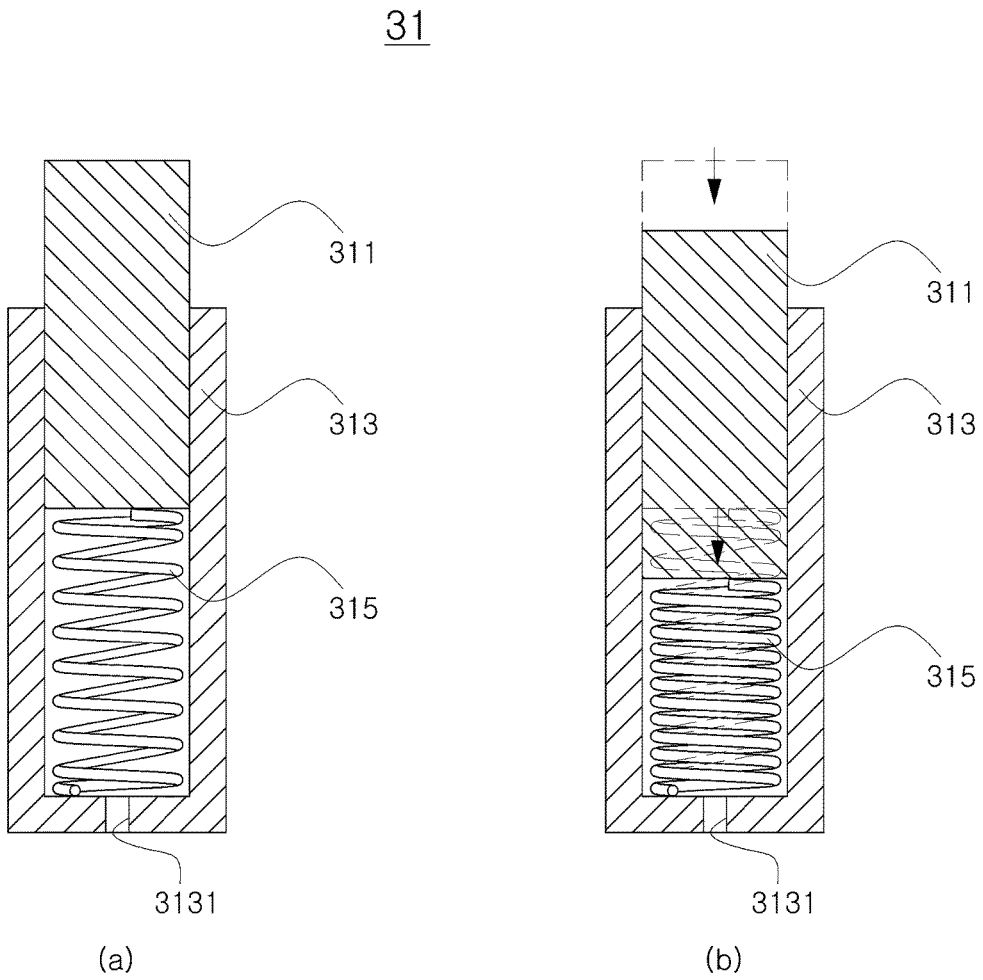
FIG. 9 is a schematic diagram for describing an operation of a lodging speed decreasing part of the device for rotating the cover of the trash can according to the exemplary embodiment of the present invention.

FIG. 8 is a schematic diagram for describing the lodging of the cover by the device for rotating the cover of the trash can according to the exemplary embodiment of the present invention, and FIG. 9 is a schematic diagram for describing an operation of the lodging speed decreasing part of the device for rotating the cover of the trash can according to the exemplary embodiment of the present invention.

A process of an operation of the rotating device 1 when the first external force applied to the external force applying part 10 is released will be described with reference to FIGS. 8 and 9.

When the first external force applied to the external force applying part 10 is released, the cover C is lodged by the weight of the cover C based on the frame P to make a storing space M be disconnected from the outside.

When the cover C is lodged based on the second fixed rotating shaft S2 by the weight, the cover connection part 223 connected with the cover C is position-moved in the down direction, and the first rotating part 2213 is rotated based on the rotating connection part 2211 in the second direction R2. In this case, the second direction R2 is a counterclockwise direction. The first rotating part 2213 is rotated in the second direction R2, so that the transformation part 23 is position-moved in the down direction, and when the first connection part 21 connected with the transformation part 23 is interconnected with the transformation part 23 and is position-moved in the down direction, the external force applying part 10 is returned to a state before the first external force is applied.

In this case, when the first rotating part 2213 is rotated in the second direction R2, the lodging speed decreasing part 31 is elastically transformed and provides restoration force.

Particularly, the lodging speed decreasing part 31 includes a position moving part 311 connected with the transformation part connection part 221, a body part 313, which slides while accommodating the position moving part 311, and a spring part 315 elastically transformed by the position moving part 311 while being accommodated in the body part 313, and the body part 313 includes a through-hole 3131, through which air stored in the storing space is discharged to the outside, or external air flows into the storing space according to a change in a size of the storing space by the position movement of the position moving part 311.

A speed of the position movement of the position moving part 311 is determined according to the quantity of air flowing in or discharged through the through-hole 3131. The through-hole 3131 may be formed to be smaller than that of a cross-section of the position moving part 311. For example, when a size of the storing space is decreased by the position moving part 311, the air storing in the storing space may be discharged through the through-hole 3131, and in this case, the quantity of air discharged through the through-hole 3131 is limited, thereby affecting as a factor hindering the position movement of the position moving part 311. In contrast to this, when a size of the storing space is increased by the position moving part 311, air may flow in the storing space from the outside through the through-hole 3131, and in this case, the quantity of inflow air through the through-hole 3131 is limited, thereby affecting as a factor hindering the position movement of the position moving part 311.

The through-hole 3131 of the rotating device 1 according to the exemplary embodiment is formed to be smaller than a cross-section of the position moving part 311, so that a speed of the position movement of the position moving part 311 may be decreased by air flowing-in or discharged through the through-hole 3131.

Further, the technology applied to the lodging speed decreasing part 313 may also be equally applied to the standing speed decreasing part 33.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device interfaced to a cover of a trash can, the device rotating the cover of the trash can, the device comprising:

the cover interfaced to the trash can by a rotating shaft, the trash can formed with a predetermined space by a frame and the cover and the device operates the cover be open based on the frame so that the predetermined space is exposed to the outside, or the device operates the cover be closed on the frame so that the predetermined space is disconnected with the outside, the device comprising:

an external force applying part rotated by first external force based on a first fixed rotating shaft fixed to the frame;

a mediating part, which mediates the external force applying part and the cover, and is interconnected to a rotation of the external force applying part by the first external force to make the cover be stood based on the frame, and makes the cover be lodged based on the frame by weight of the cover when the first external force is released;

a movement speed decreasing part, which is mounted between the frame and the mediating part, is elastically transformed according to a position movement of the mediating part, and decreases a speed of the position movement of the mediating part;

wherein when the cover is open, the cover is limited by second external force, the mediating part is transformed by the rotation of the external force applying part by the first external force and prevents the first external force from being transmitted to the cover;

wherein the mediating part includes a first connection part connected with the external force applying part, a transformation part connected with the first connection part and transformed by the rotation of the external force applying part by the first external force when the standing of the cover is limited by the second external force, and a second connection part connecting the transformation part and the cover, and when the second external force is not present, the transformation part is interconnected by the first external force applied to the external force applying part and position-moves the connected second connection part to make the cover be rotated based on a second fixing rotating shaft, and when the standing of the cover is limited by the second external force, the transformation part is transformed by the rotation of the external force applying part by the first external force to prevent the second connection part from being position-moved;

wherein the second connection part includes a transformation part connection part connected with the transformation part, and a cover connection part connected with the cover;

wherein the movement speed decreasing part includes a lodging speed decreasing part, which is connected with the cover connection part while being fixed to the frame, is elastically transformed by the cover connection part interconnected with the cover when the cover is lodged, and decreases a lodging speed of the cover by restoration force by elastic transformation, and a standing speed decreasing part, which is connected with the transformation part connection part while being fixed to the frame, is elastically transformed by the transformation part connection part interconnected with the cover when the cover is stood, and decreases a speed of the standing of the cover by restoration force by an elastic transformation; and wherein the transformation part connection part includes a rotating connection part rotatably connected to a third fixed rotating shaft fixed to the frame, a first rotating part rotated based on the cover connection part while being connected to the cover connection part, a second rotating part rotated based on the transformation part while being connected with the transformation part, and a contact part which is in contact with the standing speed decreasing part.

2. The device of claim 1, wherein when the second external force is not present, the transformation part is transformed to have a second length from a first length by the first external force applied to the external force applying part, and when the standing of the cover is limited by the second external force, the transformation part is transformed to have a third length from the first length by the first external force applied to the external force applying part, and the second length is smaller than the third length.

3. The device of claim 1, wherein when the first external force is applied to the external force applying part, the first rotating part is rotated in a first direction based on the rotating connection part, and when the first external force applied to the external force applying part is released, the first rotating part is rotated in a second direction based on the rotating connection part, and when the first rotating part is rotated in the second direction, the lodging speed decreasing part is elastically transformed and provides restoration force.

4. The device of claim 1, wherein when the first external force is applied to the external force applying part, the second rotating part is rotated in a first direction based on the rotating connection part, and when the first external force applied to the external force applying part is released, the second rotating part is rotated in a second direction based on the rotating connection part, and when the second rotating part is rotated in the first direction, the standing speed decreasing part is elastically transformed by a contact with the contact part and provides restoration force.

5. The device of claim 1, wherein the lodging speed decreasing part includes a position moving part connected with the transformation part connection part, a body part, which slides while accommodating the position moving part, and a spring part elastically transformed by the position moving part while being accommodated in the body part, and the body part includes a through-hole, through which air stored in a storing space is discharged to the outside, or external air flows into the storing space according to a change in a size of the storing space by the position movement of the position moving part, and the speed of the position movement of the position moving part is determined according to the quantity of air flowing in or discharged through the through-hole.

6. The device of claim 5, wherein the speed of the position movement of the position moving part is decreased by air flowing in or discharged through the through-hole.

* * * * *